United States Patent [19]

Matoba

[11] Patent Number: 4,594,581

[45] Date of Patent: Jun. 10, 1986

[54] FIRE ALARM SYSTEM

[75] Inventor: Kiyoshi Matoba, Tokyo, Japan

[73] Assignee: Nohmi Bosai Kogyo Co. Ltd., Tokyo, Japan

[21] Appl. No.: 572,425

[22] PCT Filed: Jun. 7, 1983

[86] PCT No.: PCT/JP83/00188

§ 371 Date: Jan. 10, 1984

§ 102(e) Date: Jan. 10, 1984

[87] PCT Pub. No.: WO83/04450

PCT Pub. Date: Dec. 22, 1983

[30] Foreign Application Priority Data

Jun. 8, 1982 [JP] Japan ..... 57-96948

[51] Int. Cl.[4] ..... G08B 1/00; G08B 17/10

[52] U.S. Cl. ..... 340/531; 340/555; 340/628; 340/630; 356/438

[58] Field of Search ..... 340/531, 555, 556, 557, 340/564, 568, 628–630, 680, 679; 350/353, 96.23; 356/438; 455/600, 601, 605, 606, 611

[56] References Cited

U.S. PATENT DOCUMENTS

| | | | |
|---|---|---|---|
| 3,683,352 | 8/1972 | West et al. | 340/557 |
| 4,187,421 | 2/1980 | Key et al. | 455/601 |
| 4,258,360 | 3/1981 | Tagashira | 340/630 |

*Primary Examiner*—Donnie L. Crosland

*Attorney, Agent, or Firm*—Werner W. Kleeman

[57] ABSTRACT

An alarm system for serving notice of abnormalities such as fire, burglary or other malfunctions has extinction-type separated smoke detectors which detect smoke by exploiting the phenomenon that the intensity of a light beam emitted by a light transmitter toward a light receiver remote from the light transmitter undergoes attenuation due to the occurrence of smoke. The alarm system utilizes the light beam as a carrier for transmitting a signal indicative of an abnormality, thereby reducing the number of line conductors required for signal transmission in this kind of alarm system while signal transmission is rendered less susceptible to the influence of electromagnetic interference. The light transmitter is provided with a signal input circuit composed of an encoder and a serial-to-parallel conversion circuit for receiving the signal to be transmitted and a modulating circuit for modulating a current for driving the light transmitter with the output signal of the signal input circuit. The light receiver includes a demodulator circuit for detecting the modulated signal from the output signal of a photo-electric element and a signal output circuit composed of a serial-to-parallel conversion circuit and a decoder for restoring the signal for transmission from the output of the modulator circuit. When a plurality of these smoke detectors are connected in series, the abnormality alarm signal is transmitted through the light beams in each of the detectors to a receiver unit.

16 Claims, 6 Drawing Figures

FIRE ALARM SYSTEM

BACKGROUND OF THE INVENTION

The present invention broadly relates to fire alarm equipment or systems and, more particularly, pertains to a new and improved construction of an alarm system in which smoke detecting light beams of extinction-type smoke detectors having spatially separate light transmitters and receivers are utilized as paths or carriers for signal transmission.

Generally speaking, the method of the present invention employs individual extinction-type smoke detectors for detecting smoke on the principle of attenuation of a light beam extending between a light transmitter and separate light receiver in the presence of smoke. In other words, the method of the present invention is for operating a fire alarm system and comprises the steps of employing at least two extinction-type smoke detectors each having a light transmitter and a light receiver separate from the light transmitter for detecting smoke by measuring the attenuation in the presence of smoke of a light beam transmitted from the light transmitter to the separate light receiver and generating an information-bearing signal in response to a physical parameter detected and evaluated by electronic circuitry.

An alternate method of the present invention for operating a fire alarm system comprises the steps of employing at least two extinction-type smoke detectors each having a light transmitter and a light receiver separate from the light transmitter for detecting smoke by measuring the attenuation in the presence of smoke of a light beam transmitted from the light transmitter to the separate light receiver, generating a fire alarm signal in at least one of the separate light receivers in response to a detection of smoke and conducting the fire alarm signal to the light transmitter of a subsequently arranged smoke detector of the extinction-type smoke detectors.

The first alarm system of the present invention employs at least two extinction-type smoke detectors for detecting smoke by the attenuation of at least one light beam in the presence of smoke and comprises a light receiver for each of the at least two extinction-type smoke detectors and a light transmitter arranged separate and remote from the light receiver for each of the at least two extinction-type smoke detectors for transmitting a light beam to the light receiver.

In hitherto known fire alarm systems, a desired number of fire or smoke detectors of thermal, ionization, light-scattering, extinction or radiation types have been installed according to requirements at locations in buildings, factories, underground markets, tunnels, hangars, warehouses and similar structures and interconnection among these fire or smoke detectors as well as their connection to a receiver unit or central station are realized by using conductors which serve for both power supply and signal transmission, as is disclosed, for example, in Japanese Utility Model Publication No. 39518/1980. Accordingly, the total length of the signal conductors utilized is enormous, involving extremely high expenditures for the wiring.

The same disadvantage also applies to the wiring for signalling equipment other than fire alarm systems such as, for example, failure alarm signal transmission for machine tools, transmission of information in burglar alram systems and similar systems. Furthermore, such signal lines are prone to pick up electric noise or interference generated by various instruments or devices, possibly causing erroneous operation such as the generation of a false fire alarm signal or false failure alarm signal.

SUMMARY OF THE INVENTION

Therefore, with the foregoing in mind, it is a primary object of the present invention to provide a new and improved method and apparatus for detecting fire conditions and/or transmitting signals and which do not exhibit the aforementioned drawbacks and shortcomings of the prior art techniques and constructions.

Another and more specific object of the present invention aims at providing a new and improved construction of a fire alarm system of the previously mentioned type in which the smoke-detecting light beams are exploited for the transmission of signals generated by the fire alarm system or by a related or unrelated alarm system.

A further significant object of the present invention aims at providing a new and improved construction of a fire alarm system of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the method of the present invention is manifested by the features that it utilizes the light beam as a carrier for transmitting an information-bearing signal.

In other words, the method of the present invention for operating a fire alarm system comprises the step of utilizing at least one light beam of the at least two extinction-type smoke detectors as a carrier for transmitting the information-bearing signal.

An alternate method of the present invention comprises the steps of employing circuitry of the light transmitter of the subsequent smoke detector for modulating the light beam transmitted by the light transmitter of the subsequent smoke detector to represent the fire alarm signal; transmitting the modulated light beam to the light receiver of the subsequent smoke detector; receiving the modulated light beam in the light receiver of the subsequent smoke detector; employing circuitry of the light receiver of the subsequent smoke detector for demodulating the received modulated light beam to extract the first alarm signal; and conducting the extracted fire alarm signal to further circuitry.

The fire alarm system of the present invention comprises a signal input circuit for each light transmitter for receiving a signal to be transmitted and comprising: an encoder; a parallel-to-serial converter connected subsequent to the encoder; a light emitter for generating the light beam; a light emission power source for supplying a light emission current to the light emitter; and a modulator connected subsequent to the parallel-to-serial converter and intermediate the light emission power source and the light emitter for modulating the light emission current by an output signal of the signal input circuit.

An alternate embodiment of the fire alarm system of the present invention comprises a photoelectric element for each light receiver for generating an electronic signal in response to a detection of the light beam; a demodulator for each light receiver and connected subsequent to the photoelectric element for demodulating the electronic signal; a signal output circuit for each light receiver for forming an output signal from the demodulated electronic signal and comprising: a serial-to-parallel converter connected subsequent to the demodulator; and a decoder connected subsequent to the serial-to-parallel converter.

Each extinction-type smoke detector comprises a light projector or transmitter including a light emission element and a lighting power circuit on the one hand and a light receiver including a photoelectric element and a fire detection or discrimination circuit on the other hand. The light projector or transmitter and the light receiver essentially constituting each such extinction-type smoke detector are separately installed at different locations at distances of 10 meters to several hundred meters therebetween.

When smoke intervenes between the light projector or transmitter and the light receiver, the light beam transmitted therebetween is attenuated (extinction effect). This phenomenon is exploited by the present invention in evaluating or determining the occurrence or location of a fire. Heretofore, the light beam was used only for the detection of smoke, and signal transmission was effected through additionally provided means.

In this connection, various tests performed by the inventor have shown that attenuation of the intensity of the light beam on the order of 20% to 30% can ensure reliable smoke detection in practice, and an attenuation of 100% (i.e. complete extinction) is unnecessary. Starting from this experimentally established fact, the inventor contemplated the positive utilization or exploitation of the light beam emitted by the light projector or transmitter to the separate or remote light receiver of the extinction-type smoke detector for the transmission of information-bearing signals. More specifically, the inventor proposes using the light beam as a carrier or carrier wave for a fire alarm signal or other analogous signals by correspondingly modulating the light beam used as the carrier by the signal to be transmitted. Thus, according to the invention, the quantity of conductors required for signal transmission can be correspondingly decreased, the adverse influence of electrical or electromagnetic noise or interference can be reduced to a minimum and it has furthermore been confirmed that attenuation of the light ray or beam in the range utilized for smoke detection does not exert any practically appreciable influence on the transmission of a fire alarm signal or other analogous signals.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
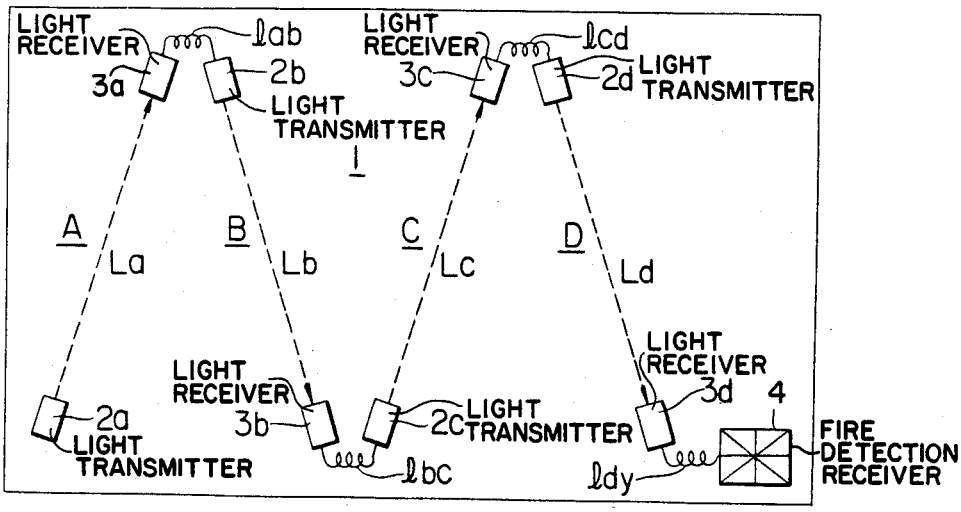
FIGS. 1 and 4 schematically show two different embodiments of the present invention.

Describing now the drawings, it is to be understood that to simplify the showing thereof only enough of the structure of the fire alarm system has been illustrated therein as is needed to enable one skilled in the art to readily understand the underlying principles and concepts of this invention. Turning now specifically to FIG. 1 of the drawings, the apparatus illustrated therein by way of example and not limitation and employed to realize the method as hereinbefore described will be seen to comprise four extinction-type smoke detectors A, B, C and D having light transmitters as well as separate and remote light receivers and a fire alarm signal receiver unit 4 installed within a building 1 of a factory or the like. The smoke detectors A, B, C and D each comprise separated pairs of the light projectors or transmitters *2a, 2b, 2c* and *2d* and associated light receivers *3a, 3b, 3c* and *3d*, respectively.

In FIG. 1, the reference characters La, Lb, Lc and Ld denote light beams, while the reference characters lad, lbc and lcd denote signal lines or conductors through which output terminals of the light receivers *3a, 3b* and *3c* of the preceding smoke detectors A, B and C, respectively are connected to the light projectors or transmitters *2b, 2c* and *2d* of the subsequent smoke detectors B, C and D, respectively. A signal line ldy connects an output of the light receiver *3d* of the smoke detector D to the fire alarm signal receiver unit 4.

Figure 2:
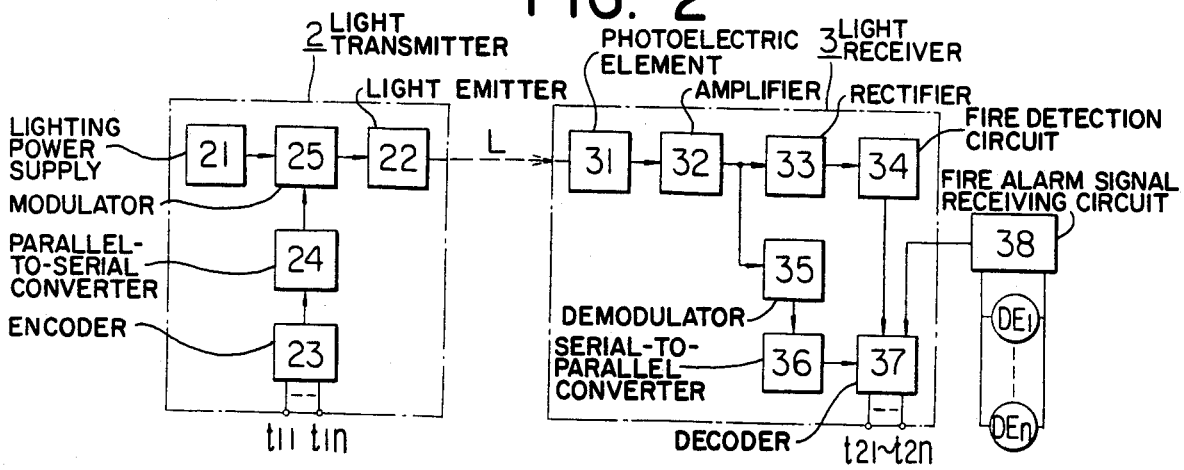
FIGS. 2 and 5 schematically show a typical arrangement of a light projector and a light receiver employed in the systems shown in FIGS. 1 and 4, respectively.

FIG. 2 shows in a block diagram a typical arrangement of the light projector or transmitter 2 and the light receiver 3 which essentially constitute each of the extinction-type smoke detectors A, B, C and D. The light projector device or transmitter 2 includes a lighting power circuit 21 for supplying a current to a light emission element 22, typically a light emission diode, an encoder 23, a parallel-to-serial converter 24 and a modulating circuit 25. The encoder circuit 23 is provided with a plurality of input terminals $t_{11}$ to $t_{1n}$ and serves to convert a decimal code supplied externally to these input terminals $t_{11}$ to $t_{1n}$ into a BCD or binary-coded decimal code, which is then supplied to the parallel-to-serial converter or conversion circuit 24, which may comprise a shift register or the like, to undergo a parallel-to-serial conversion. The serial output of the parallel-to-serial converter 24 is supplied to the modulating circuit 25 together with the output from the lighting power circuit 21 to modulate the current supplied by the lighting power circuit 21 to the light emission element 22, which then produces or emits a correspondingly modulated light beam.

The light receiver 3 comprises a photoelectric element 31 such as a solar cell, an amplifier 32, a rectifier circuit 33, a fire detection or discriminating circuit 34, a demodulating circuit 35, a serial-to-parallel converter or conversion circuit 36 and a decoder 37. The decoder 37 may comprise a matrix circuit and serves to convert the BCD code into a decimal code signal for transmission to and output at a plurality of output terminals $t_{21}$ to $t_{2n}$.

The decoder 37 has its inputs supplied with the output from the fire detection or discriminating circuit 34, as well as with the output from the serial-to-parallel converter or converter circuit 36. The serial-to-parallel converter 36 may comprise a shift register and serves for conversion of the serial signal to a parallel signal.

A reference numeral 38 denotes a fire alarm signal receiving circuit which is adapted to be installed in the light receiver device 3 or light projector device or transmitter 2 or in the vicinity thereof when spot-type fire detectors such as those of the thermal type, ionization type or light-scattering type are employed in addition to extinction-type smoke detectors such as the smoke detectors A, B, C and D. The fire alarm signal receiver circuit 38 is connected to spot-type fire detectors $DE_1$ to $DE_n$, wherein the output signal of the fire alarm signal receiver circuit 38 is supplied to the decoder 37 (or to the encoder 23).

Operation of the inventive system will now be described in relation to FIGS. 1 and 2. In the normal or quiescent state, the light emission elements 22 of the light projector devices or transmitters 2 are energized by a DC current supplied by respective associated lighting power circuits 21 to emit light beams La, Lb, Lc and Ld, respectively, which are received by the photoelectric elements 31 of the light receiver devices 3*a* to 3*d*, respectively. The outputs corresponding to the received beams La to Ld are previously set above a predetermined value so that in the normal state the output signal of the photoelectric elements 31 will not be output as a fire alarm signal through the amplifier 32, the rectifier circuit 33 and the fire detection or discrimination circuit 34.

Figure 3:
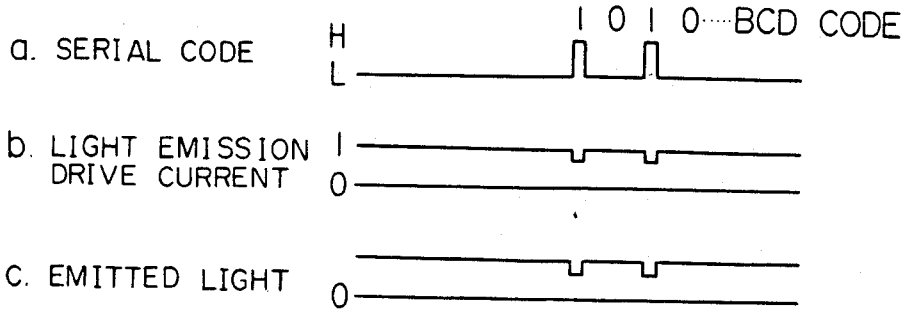
FIGS. 3 and 6 schematically show signal waveform diagrams of light outputs.

It is now assumed that a fire occurs in the second zone, i.e. the area monitored by the extinction-type smoke detector B comprising the light projector or transmitter 2*b* and the separate and remote light receiver 3*b*. The intensity of the light beam Lb is attenuated by the smoke of the fire, resulting in the output level of the photoelectric element 31 of the light receiver device 3*b* being lowered below the preset threshold or reference value. Consequently, variation in the output signal level of the photoelectric element 31 is detected as a fire alarm signal through cooperation of the amplifier 32, the rectifier circuit 33 and the fire detection or discriminator circuit 34, to be subsequently supplied as an input to the decoder 37. Consequently, a logic signal of H or high level appears at the output terminal $t_{22}$ of the decoder 37, which output terminal $t_{22}$ corresponds to the second fire-monitoring zone in concern. The signal of logic H or logical high is then supplied to the input terminal $t_{12}$ of the light projector device or transmitter 2*c* constituting a part of the smoke detector C of the succeeding stage, while the other input terminals $t_{21}$, $t_{23}$ to $t_{2n}$ of the light projector device or transmitter 2*c* remain at the logic L or low level. In the projector device 2*c*, the logical high or the signal of H state or level supplied to the input terminal $t_{12}$ is converted into a corresponding BCD code by the encoder 23. The BCD coded signal is subsequently converted into a serial code by the parallel-to-serial converter or conversion circuit 24 and is supplied by the parallel-to-serial converter 24 to the modulating circuit 25. In response to the serially coded signal (refer to FIG. 3, at a) supplied from the parallel-to-serial converter or converter circuit 24, the modulating circuit 25 correspondingly pulse-modulates the current supplied from the lighting power source 21 in a manner illustrated in FIG. 3 at b. Consequently, the light beam Lc emitted by the light emission element 22 undergoes a pulse modulation as illustrated in FIG. 3 at c. The pulse-modulated light beam (cf. FIG. 3, c) produced or emitted by the light projector device or transmitter 2*c* is received by the photoelectric element 31 of the associated light receiver device 3*c*, the output signal of the element 31 being amplified by the amplifier 32 and rectified by the rectifier circuit 33 to be supplied to the input of the fire detection or discriminator circuit 34. However, since it is assumed that fire is absent in the third zone, i.e. the area monitored by the smoke detector C comprising the light projector or transmitter 2*c* and the separate and remote light receiver 3*c*, the input signal to the fire detection or discriminator circuit 34 is above the predetermined or preset value because the intensity of the light beam Lc is not attenuated by smoke. Thus, the fire detection or discriminator circuit 34 produces no fire alarm signal. On the other hand, the output signal of the amplifier 32 which is pulse-modulated in accordance with the modulated light beam Lc is supplied to the demodulating circuit 35 which detects the pulse signal to thereby produce a serially coded signal illustrated in FIG. 3 at a. This serially coded signal is converted into a corresponding parallel BCD code by the serially-to-parallel converter or converter circuit 36, to be applied to the input of the decoder 37 which is adapted to convert the output signals from the serial-to-parallel converter or converter circuit 36 and the fire detection or discriminator circuit 34 into a decimally coded signal. However, since the fire detection or discriminator circuit 34 does not produce a fire alarm signal at this time, only the parallel BCD code supplied from the serial-to-parallel converter or conversion circuit 36 is converted into the decimally coded signal which is output at the output terminals $t_{21}$ to $t_{2n}$, among which only the output terminal $t_{22}$ corresponding to the second monitored zone where the smoke is detected is set to the H or logically high state.

The signal transmitting operation described above takes place between the light receiver 3*c* and the light projector or transmitter 2*d* as well as between the light projector or transmitter 2*d* and the light receiver 3*d* in a similar manner and consequently the signal of H level or logically high signal appearing at the output terminal $t_{22}$ among the output terminals $t_{21}$ to $t_{2n}$ of the final stage light receiver 3*d* is sent to the fire detection receiver unit 4 through the signal line conductor ld4 (e.g. a signal line cable composed of n conductors). The fire detection receiver unit 4 responds to the input signal "H" to actuate a zone-associated relay (not shown) for reporting that a fire has occurred in the second fire-monitoring zone. In this way, when at least one of the extinction-type smoke detectors of a plurality of extinction-type smoke detectors detects smoke accompanying a fire, only the signal of the corresponding or associated output terminal changes its potential state from L or logical low level to H or logical high level, which H or logical high level signal is transmitted as a fire alarm signal through the other successive smoke detectors and their light beams to the fire alarm signal receiver unit or receiving circuit 4, which then actuates the relay specific to the zone concerned to thereby produce information of the occurrence of a fire on a zone identification basis.

Figure 4:
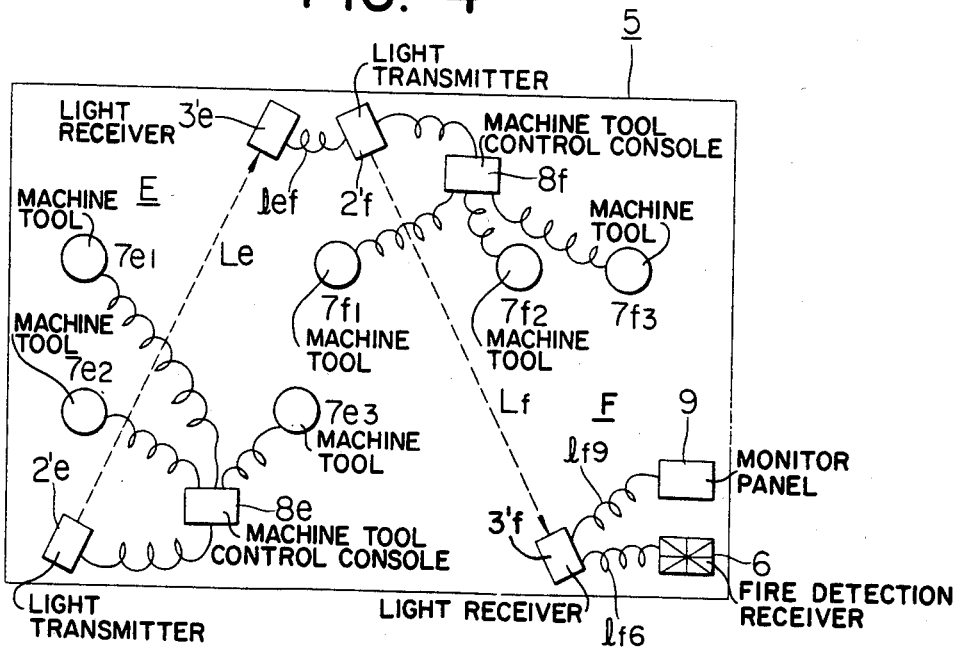

FIG. 4 shows in a schematic diagram another embodiment of the invention in which the light beams for detecting smoke are also utilized as a carrier or carrier wave for a signal indicating malfunction or failure in machine tools. In the illustrated embodiment, two extinction-type smoke detectors E and F having separate light transmitters 2 and light receivers 3 are disposed in a factory area 5 in which there is installed a group of machine tools $7e_1$, $7e_2$ and $7e_3$ provided with a control console 8*e* and a second group of machine tools $7f_1$, $7f_2$ and $7f_3$ equipped with a common control console 8*f*. When a failure or malfunction occurs in the machine tools of the first or second group, a failure alarm signal is supplied to a light projector or transmitter 2'*e* or 2'*f* through the associated control console 8*e* or 8*f*. The smoke detectors E and F constituted by the light projectors or transmitters 2'*e* and 2'*f* and light receivers 3'*e* and 3'*f*, respectively, are separately mounted on walls of the factory structure 5.

In FIG. 4, Le and Lf denote light beams. The output terminals of the receiver 3'*e* belonging to the preceding stage smoke detector E are connected to the light projector or transmitter 2'*f* of the subsequent stage smoke detector F through an interconnecting signal line or conductor lef, while the output terminal of the subsequent light receiver 3'*f* is connected to the fire detection receiver unit 6 through the interconnecting signal line or conductor lf6. The failure alarm signal input to the light projector or transmitter 2'*e* or 2'*f* through the machine tool control console 8*e* or 8*f* is transmitted via the light beam Le and/or Lf to the light receiver 3'*f* and hence to a monitor panel 9 via a connecting line or conductor $lf_9$. The monitor panel 9 serves to give information about which of the machine tools as malfunctioned or failed.

Figure 5:
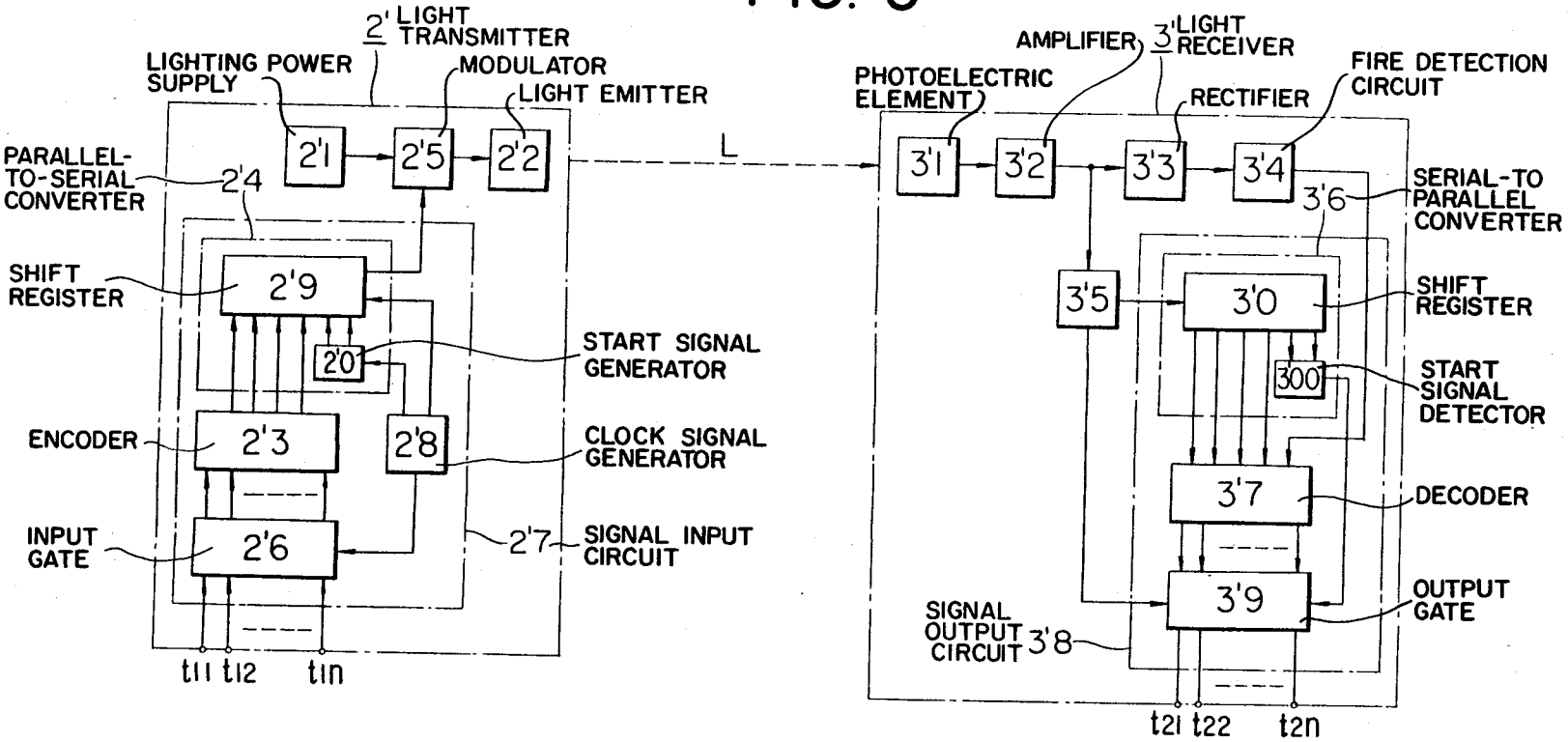

FIG. 5 shows in a block diagram a typical arrangement of the light projector of transmitter 2' and the associated separate and remote light receiver 3' essentially constituting one of the extinction-type smoke detectors E and F. When a malfunction occurs in a given one of the machine tools $7e_1$ to $7e_3$ or $7f_1$ to $7f_3$, one of a set of associated decimal codes previously prepared for each of the machine tools and representing the specific failure is applied to the input terminals $t_{11}$ to $t_{1n}$ of the light projector or transmitter 2' externally through the associated machine tool control console 8*e* or 8*f*, whereby the light beam L produced by the light projector or transmitter 2' is correspondingly pulse-modulated. The light beam L thus having undergone pulse-modulation is received by the light receiver 3' and demodulated to produce a decimally coded signal which is taken out on the output terminals to $t_{21}$ to $t_{2n}$. In other words, the smoke detector shown in FIG. 5 operates in a manner similar to those in FIG. 1 and 2.

More specifically, the light projector or transmitter 2' comprises a light emitter or emission element $2'_2$ such as a light emitting diode capable of emitting visible or infrared light rays, a lighting power source circuit $2'_1$ for supplying a driving current to the light emitter or emission element $2'_2$, a signal input circuit $2'_7$ and a modulator circuit $2'_5$ for pulse-modulating the driving current with the output signal of the signal input circuit $2'_7$. The signal input circuit $2'_7$ comprises an input gate $2'_6$ essentially constituted by AND circuits or the like, an encoder $2'_3$ essentially constituted by a matrix circuit or the like and adapted to convert a decimal code to a parallel BCD code, a parallel-to-serial conversion circuit $2'_4$ which in turn is essentially constituted by a shift register $2'_9$, a start signal generating circuit $2'_0$, and a clock signal generating circuit $2'_8$.

On the other hand, the light receiver 3' comprises a photoelectric element $3'_1$ such as a solar cell, an amplifier $3'_2$, a rectifier circuit $3'_3$, a fire discriminating or detection circuit $3'_4$ which is essentially constituted by a comparator, a switching circuit and the like and is adapted to detect the occurrence of fire when an electric signal level representing the intensity of a received light beam drops below a predetermined value due to attenuation of the light beam, to thereby produce a fire alarm signal, a demodulator circuit $3'_5$ for detecting and extracting the pulse signal from the signal derived from the received light beam, and a signal output circuit $3'_8$ which in turn includes a serial-to-parallel converter circuit $3'_6$ essentially constituted by a shift register $3'_0$ and a start signal detection circuit $3'_{00}$ for converting the serial code to a parallel code, a decoder $3'_7$ essentially constituted by a matrix circuit or the like and adapted to convert the parallel BCD code into a decimally coded signal, and output gate $3'_9$.

Describing now the operation of the apparatus shown in FIGS. 4 and 5, the light emitter or emission element $2'_2$ is energized by the driving current supplied from the lighting power circuit $2'_1$ to emit the light beam L directed at the photoelectric element $3'_1$ of the light receiver 3'. When the intensity of the light beam L is attenuated due to the presence of smoke produced by combustion, resulting in the level of the output signal of the photoelectric element $3'_1$ falling below a predetermined value, the fire discriminating or detection circuit $3'_4$ produces a fire alarm signal which is supplied to the decoder $3'_7$. Assuming that the fire occurs in the first zone monitored by the smoke detector E shown in FIG. 4, the decoder $3'_7$ causes the corresponding output terminal $t_{21}$ of the output gate $3'_9$ to be at H level or logical high. On the other hand, the output terminal $t_{22}$ of the output gate $3'_9$ is caused to be at H level or logical high when the smoke detector F monitoring the second zone detects combustion. Transmission of the alarm signal indicating a fire and the alarm signal indicating a malfunction in a machine tool which are applied to the input terminals $t_{11}$ to $t_{1n}$ of the light projector or transmitter 2' is performed in the manner mentioned below.

Figure 6:
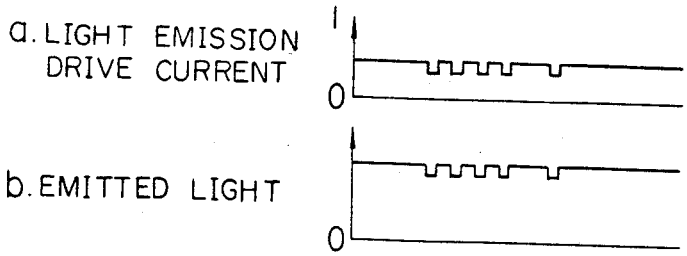

The input gate $2'_6$ is periodically opened by the clock signal supplied from the clock signal generating circuit $2'_8$ at a predetermined timing frequency, e.g. every second, whereby the signal applied to the input terminals $t_{11}$–$t_{1n}$ of the input gate $2'_6$ is gated into the encoder $2'_3$. In this connection, it is to be noted that the signal input into the encoder $2'_3$ is a decimally coded signal. Accordingly, the encoder $2'_3$ operates to convert the decimal code to a corresponding BCD code which is then supplied to the shift register $2'_9$. At the same time, the start signal generating circuit $2'_0$ produces a start code under the control of the clock signal, whereby the start code is supplied to the shift register $2'_9$. In response to the clock signal, the shift register $2'_9$ converts the parallel code consisting of the start code and the BCD code to a serial code which is then supplied to the modulating circuit $2'_5$. In accordance with the serial code thus produced, the driving current supplied to the light emitter or emission element $2'_2$ undergoes a pulse modulation, as is illustrated in FIG. 6 at a. Thus, the light emitter or emission element $2'_2$ emits the light beam L which is pulse-modulated in the manner illustrated in FIG. 6 at b.

In the light receiver 3', when the start signal is detected by the demodulator circuit $3'_5$ from the output signal of the photoelectric element $3'_1$ after having been amplified by the amplifier $3'_2$, the demodulator circuit $3'_5$ demodulates the modulated input signal back to a serial pulse code to be supplied to the shift register $3'_0$ and at the same time disables the output gate $3'_9$ to inhibit signal generation. The shift register $3'_0$ operates to convert only the BCD code portion of the input serial code into a parallel code which is supplied to the decoder $3'_7$. The latter converts the BCD code into a decimally coded signal to be subsequently supplied to the output gate $3'_9$. Moreover, the start code is detected by the start signal detecting circuit $3'_{00}$, whereupon the output gate $3'_9$ is opened, allowing the decimally coded signal to be supplied to the fire or smoke detector of the succeeding stage, a fire alarm receiver 6 or a monitor panel 9 for indicating the occurrence of fire or failure.

Operation of the light receiver 3' is repeated every time the demodulating circuit $3'_5$ detects the modulated signal, to thereby perform signal transmission.

The foregoing description has been made in connection with the generation of a fire alarm signal or a signal indicating a failure or malfunction in a machine tool. It will however be appreciated that signal transmission using the light beam as the signal carrier may be equally well adopted in a burglar alarm system. Furthermore, although the light emitters or emission elements 22 and $2'_2$ are continuously lit by the DC lighting currents supplied from the respective lighting power circuits 21 and $2'_1$ in the embodiments shown in FIGS. 2 and 5, these light emitters or emission elements 22 and $2'_2$ may be driven by a pulse-like current to thereby emit a pulsed light beam. Furthermore, for modulating the driving current supplied by the lighting power circuit 21 or 21' to represent the output signal supplied from the parallel-to-serial converter or conversion circuit 24 or $2'_4$ through the modulating circuit 25 or $2'_5$, not only amplitude modulation but also frequency modulation or phase modulation may be employed. Besides, the signals transmitted between the light receiver **3*a*, 3*b* or 3*c* of the smoke detector of the preceding stage and the light projector or transmitter 2*b*, 2*c* or 2*d* of the succeeding smoke detector or between the light receiver 3*d* of the final stage smoke detector and the receiver unit 4 in the embodiment shown in FIG. 1 or the signal supplied to the signal input circuit $2'_7$ of the light projector or transmitter 2' as well as the signal produced by the signal output circuit $3'_8$ of the light receiver 3' described in conjunction with FIG. 5** may be in the form of either a BCD code, a frequency-modulated signal or an amplitude-modulated signal instead of the decimally coded signal. This signal may also be serially coded instead of parallel.

Referring to FIG. 1, the interconnecting signal lines lab, lbc, led and ld4 may be replaced by light beams for signal transmission. In that case, each of the light receivers **3*a*, 3*b* and 3*c* is provided with a pulse generating circuit and a light emitter or emission element, wherein the pulse generating circuit is operated in accordance with the serial BCD code to thereby cause the light emitter or emission element to emit a correspondingly pulsed light beam. On the other hand, each of the light projectors or transmitters 2*bc*, 2*c* and 2*d* is provided with a photoelectric element at a position opposite to the light emitter or emission element or is coupled thereto through an optical fiber. Additionally, a circuit for converting the serially coded signal produced by the photoelectric element to parallel code is incorporated in each light projector or transmitter. Furthermore, with a view to preventing the transmitted signal from being falsified in the system illustrated by way of example in FIG. 5, the light projector or transmitter 3' may be so arranged that the same signal is successively transmitted three times, while three shift registers $3'_0$ are provided in the light receiver 3'** so that three identical signals can be placed successively in the three shift registers. In that case, when the contents of at least two shift registers are found to coincide with each other by a coincidence circuit, the signal placed in these two shift registers may be output to the decoder $3'_7$.

In another embodiment, an input gate may be provided at the output side of the encoder, while an output gate may be provided at the input side of the decoder.

It will now be understood that according to the teachings of the present invention, the smoke detecting light beam emitted from the light projector or transmitter toward the light receiver can be utilized as the carrier for transmitting not only a smoke detection signal but also other signals such as a failure alarm signal, an information or data signal or the like which may be produced in fire alarm equipment, smoke expelling apparatus, a burglar alarm system, machine tools and other similar systems, without the need for signal lines or conductors for the transmission of these signals. Thus, the quantity of signal line conductors required can be significantly reduced, while false alarm signals which would otherwise be generated under the influence of electric noise or interference involved in signal transmission can be excluded with highly improved reliability.

It is also to be understood in all of the foregoing and in the following claims that the term light includes visible or infrared light rays.

I claim:

1. A method of operating a fire alarm system, comprising the steps of:

employing at least two extinction-type smoke detectors each having a light transmitter and a light receiver separate from said light transmitter;

employing said at least two extinction-type smoke detectors for detecting smoke by measuring an attenuation in the presence of smoke of a light beam transmitted from said light transmitter to said separate light receiver;

detecting a physical parameter;

evaluating said physical parameter by electronic circuitry;

generating an information-bearing signal in response to said evaluation of said physical parameter; and utilizing at least one light beam of said at least two extinction-type smoke detectors as a carrier for transmitting said information-bearing signal.

2. The method as defined in claim 1, wherein:

said information-bearing signal is a fire alarm signal.

3. The method as defined in claim 1, wherein:

said information-bearing signal is a signal produced by a machine tool.

4. The method as defined in claim 1, wherein:

said step of generating said information-bearing signal entails generating a fire alarm signal in response to the measured attenuation of said light beam.

5. The method as defined in claim 1, wherein:

said step of generating said information-bearing signal entails generating a machine-tool malfunction alarm signal in response to the signal of a machine-tool machine malfunction sensor.

6. The method as defined in claim 1, wherein:

said information-bearing signal is a digitally encoded signal.

7. The method as defined in claim 1, wherein:

said step of utilizing said at least one light beam as a carrier entails modulating said at least one light beam to represent said information-bearing signal.

8. The method as defined in claim 7, wherein:

said step of modulating said at least one light beam entails pulse-modulating said at least one light beam.

9. The method as defined in claim 7, wherein:

said step of modulating said at least one light beam entails amplitude-modulating said at least one light beam.

10. The method as defined in claim 7, wherein:

said step of modulating said at least one light beam entails frequency-modulating said at least one light beam.

11. A method of operating a fire alarm system, comprising the steps of:

employing at least two extinction-type smoke detectors each having a light transmitter and a light receiver separate from said light transmitter;

employing said at least two extinction-type smoke detectors for effecting a detection of smoke by measuring an attenuation in the presence of smoke of a light beam transmitted from said light transmitter to said separate light receiver;

generating a fire alarm signal in at least one of said separate light receivers in response to said detection of smoke;

conducting said fire alarm signal to said light transmitter of a subsequently arranged smoke detector of said extinction-type smoke detectors;

employing circuitry of said light transmitter of said subsequently arranged smoke detector for modulating said light beam transmitted by said light transmitter of said subsequently arranged smoke detector to represent said fire alarm signal;

transmitting said modulated light beam to said light receiver of said subsequently arranged smoke detector;

receiving said modulated light beam in said light receiver of said subsequently arranged smoke detector;

employing circuitry of said light receiver of said subsequently arranged smoke detector for demodulating said received modulated light beam to extract said fire alarm signal; and conducting said extracted fire alarm signal to further circuitry.

12. The method as defined in claim 11, wherein:

said further circuitry comprises said light transmitter of a further subsequent smoke detector of said extinction-type smoke detectors.

13. The method as defined in claim 11, wherein:

said further circuitry comprises a fire detection receiver of the fire alarm system.

14. A fire alarm system employing at least two extinction-type smoke detectors for detecting smoke by the attenuation of at least one light beam in the presence of smoke, comprising:

a light receiver for each of said at least two extinction-type smoke detectors;

a light transmitter arranged separate and remote from said light receiver for each of said at least two extinction-type smoke detectors for transmitting a light beam to said light receiver thereof;

a signal input circuit for each said light transmitter for receiving a signal to be transmitted and comprising: an encoder;

a parallel-to-serial converter connected subsequent to said encoder;

a light emitter for generating said light beam;

a light emission power source for supplying a light emission current to said light emitter; and a modulator connected subsequent to said parallel-to-serial converter and intermediate said light emission power source and said light emitter for modulating said light emission current by an output signal of said signal input circuit.

15. A fire alarm system employing at least two extinction-type smoke detectors for detecting smoke by the attenuation of at least one light beam in the presence of smoke, comprising:

a light receiver for each of said at least two extinction-type smoke detectors;

a light transmitter arranged separate and remote from said light receiver for each of said at least two extinction-type smoke detectors for transmitting a light beam to said light receiver;

a photo-electric element for each said light receiver for generating an electronic signal in response to a detection of said light beam;

a demodulator for each said light receiver connected subsequent to said photo-electric element for demodulating said electronic signal;

a signal output circuit for each said light receiver for forming an output signal from said demodulated electronic signal and comprising:

a serial-to-parallel converter connected subsequent to said demodulator; and a decoder connected subsequent to said serial-to-parallel converter.

16. A fire alarm system employing at least two light extinction-type smoke detectors, comprising:

at least one light receiver for each light extinction-type smoke detector of said at least two light extinction-type smoke detectors;

at least one light transmitter for each light extinction-type smoke detector of said at least two light extinction-type smoke detectors arranged separate and remote from said at least one light receiver for transmitting a beam of light to said at least one light receiver;

said at least one light receiver detecting smoke by an attenuation of said light beam in the presence of smoke;

said at least one light transmitter comprising:

a light emission element;

a light emission power supply circuit for supplying a light emission current for said light emission element;

a signal input circuit for receiving a fire alarm signal from a light receiver of a preceding light extinction-type smoke detector and for generating an output signal in response to said received fire alarm signals;

said signal input circuit comprising an encoder and a parallel-to-serial converter;

a modulator for modulating said light emission current by said output signal of said signal input circuit and for conducting said modulated light emission current to said light emission element;

said at least one light receiver comprising:

a photo-electric element for receiving said light beam and for generating an output signal in response to a detected attenuation thereof;

an amplifier for amplifying said output signal;

a rectifier for rectifying said amplified output signal;

a fire detection circuit for producing a fire alarm signal when said rectified output signal falls below a predetermined threshold value;

a demodulator for demodulating said rectified output signal to define a signal to be transmitted;

a signal output circuit for transmitting said demodulated output signal as said signal to be transmitted; and said signal output circuit comprising a serial-to-parallel converter and a decoder.

* * * * *

UNITED STATES PATENT AND TRADEMARK OFFICE

CERTIFICATE OF CORRECTION

PATENT NO. : 4,594,581

DATED : June 10, 1986

INVENTOR(S) : KIYOSHI MATOBA

It is certified that error appears in the above—identified patent and that said Letters Patent is hereby corrected as shown below:

Column 1, line 40, delete "first" and insert --fire--

Column 1, line 67, delete "alram" and insert --alarm--

Column 2, line 49, delete "first" and insert --fire--

Column 6, line 20, delete "serially-to-parallel" and insert --serial-to-parallel--

Column 6, line 44, after ""H"", insert --or logical high--

Column 6, line 45, before "relay" insert --or zone specific--

Column 7, line 25, delete "as" and insert --has--

Column 7, line 43, after "terminals" delete "to"

Column 10, after line 26, please insert the following paragraph:

--While there are shown and described present preferred embodiments of the invention, it is to be distinctly understood that the invention is not limited thereto, but may be otherwise variously embodied and practiced

UNITED STATES PATENT AND TRADEMARK OFFICE

CERTIFICATE OF CORRECTION

PATENT NO. : 4,594,581

DATED : June 10, 1986

INVENTOR(S) : KIYOSHI MATOBA

It is certified that error appears in the above-identified patent and that said Letters Patent is hereby corrected as shown below:

within the scope of the following claims.
ACCORDINGLY, --.

--

Signed and Sealed this

Fourteenth Day of October, 1986

[SEAL]

*Attest:*

DONALD J. QUIGG

*Attesting Officer*

*Commissioner of Patents and Trademarks*